United States Patent [19]

Goldin

[11] Patent Number: 4,697,496

[45] Date of Patent: Oct. 6, 1987

[54] METHOD AND APPARATUS FOR HANDLING BELTLESS AMMUNITION IN A TWIN-BARRELED GUN

[75] Inventor: Morris Goldin, Orange, Calif.

[73] Assignee: Hughes Helicopters, Inc., Culver City, Calif.

[21] Appl. No.: 745,135

[22] Filed: Jun. 17, 1985

[51] Int. Cl.[4] ..... F41D 10/28

[52] U.S. Cl. ..... 89/33.03; 89/1.41; 89/127

[58] Field of Search ..... 89/33.03, 13.05, 1.41, 89/156, 127, 126, 155, 33.4

[56] References Cited

U.S. PATENT DOCUMENTS

| | | | |
|---|---|---|---|
| 572,771 | 12/1896 | Richmond | 89/33.03 |
| 2,767,617 | 10/1956 | Taylor | 89/33.4 |
| 2,972,286 | 2/1961 | Marquardt | 89/126 |
| 3,222,989 | 12/1965 | Kamp | 89/33.03 |
| 3,497,984 | 3/1970 | Joyce et al. | 89/33.4 |
| 3,667,147 | 6/1972 | Goldin et al. | 89/33.03 |
| 3,800,657 | 4/1974 | Broxholm et al. | 89/1.41 |
| 4,309,933 | 1/1982 | Bains | 89/33.03 |
| 4,348,941 | 9/1982 | Ketterer et al. | 89/33.03 |

*Primary Examiner*—Stephen C. Bentley
*Assistant Examiner*—Stephen M. Johnson
*Attorney, Agent, or Firm*—Beehler, Pavitt, Siegemund, Jagger, Martella & Dawes

[57] ABSTRACT

The loading, firing and ejection of beltless, cased ammunition is facilitated by the use of an oscillating breech having two breech chambers defined therethrough, which breech is disposed between two parallel ammunition chutes. Unfired rounds are provided to a load position in a first ammunition chute and the oscillating breech rotated to align one chamber with the load position. The unfired round is rammed into the aligned chamber, thereby forcing the spent cartridge just fired from the opposing end of the chamber into an eject position in a second opposing ammunition chute. Meanwhile, a second chamber within the oscillating breech is simultaneously aligned with a corresponding one of two barrel bores and fired. After firing, the oscillating breech rotates in the opposite direction to position the breech holding the just fired round in a position in alignment with the ammunition chutes while the breech having the unfired round just loaded therein is then positioned in alignment with a second one of the corresponding barrel bores. An unfired round is then loaded from the second ammunition chute, forcing the fired spent cartridge from the aligned chamber into an eject position in the opposing first ammunition chute. Therefore, unfired rounds enter through a first ammunition chute, are fed through a bore in an oscillating breech and then exit in the reverse direction in a second opposing ammunition chute. Similarly, a second group of unfired rounds are delivered through the second ammunition chute, loaded through a corresponding chamber in the oscillating breech and exit in the reverse direction through the opposing first ammunition chute.

16 Claims, 8 Drawing Figures

34
124
68
62
18
20
48
54
50
8
8
16
30
70a
16a 22
126
68
50
124
54
20
36
48
26
24
46
68

METHOD AND APPARATUS FOR HANDLING BELTLESS AMMUNITION IN A TWIN-BARRELED GUN

BACKGROUND OF THE INVENTION

1. Field of the Invention

The invention relates to the handling of beltless ammunition in an automatic weapon system, and in particular to the use of an oscillating breech for loading beltless ammunition into a twin-barreled gun.

2. Description of the Prior Art

Rapid-fire guns and cannons using multiple barrels are well known to the art and have been devised to fire both belted as well as beltless ammunition. The amount of ammunition which such guns can fire is extremely high and the limiting factor of operation often limited by the rate at which such weapons systems can fire or load the unfired rounds, and in the situation of cased ammunition, additionally handle empty cases from fired rounds. One example of a two-barreled gun using cased ammunition is shown by Marquardt, "Rapid-Fire Gun with Two Barrels and a Plurality of Firing Chambers", U.S. Pat. No. 2,972,286. In that application ammunition was provided to the firing mechanism from an upper and lower chute, moving the rounds in opposite directions as best illustrated in Marquardt's FIGS. 6 and 11. A system for loading beltless ammunition described by Wiese, "Feeding Mechanism in an Automatic Cannon for Firing Caseless Ammunition", U.S. Pat. No. 3,608,424, wherein a four-chambered drum is oscillated by a reversible electric motor. Wiese illustrates a single-barreled automatic weapon system which is able to draw ammunition from two independent magazines. However, caseless ammunition is not a practical alternative in all applications and Wiese naturally fails to show any means for removing cartridges since Wiese's automatic weapon system is restricted for use with caseless ammunition.

An additional problem with rapid-fire guns using cased ammunition is that usually a complex and intricate ejection mechanism must be devised within the breech of the gun to remove the expended cartridge after firing. Normally, this requires a reciprocating movement by first placing the unfired round into the breech and then removing the expended cartridge in the opposite direction. One prior art attempt to provide a simplified means for removing a fired cartridge as well as jammed rounds is shown by Ketterer et al, "Shoulder Arm with Swivel-Breech Member", U.S. Pat. No. 4,348,941, wherein a rotating breech includes a bore defined therethrough into which an unfired cartridge is inserted from a magazine. The breech is then rotated about an axis perpendicular to the longitudinal axis of the bore to rotate the bore through 90° to align the unfired cartridge with the barrel bore. After firing the breech is again rotated about the axis perpendicular to the longitudinal axis of the bore by an additional 90° to align the bore with an ejection opening and with an unfired round from the magazine. The new incoming unfired round thereby forces the spent cartridge from the bore out the ejection opening. During normal operation, the breech then oscillates back and forth between the firing and the loading/ejection position. However, the system of Ketterer is a single-barreled system and is not adapted to feeding multiple barrels using the same loading system, and therefore includes an inherent limitation in the firing rate of the gun.

What is needed is some means for providing cased ammunition to a multiple barreled gun which can supply unfired rounds to the corresponding multiple breeches, and simply and quickly remove the expended cartridges therefrom.

BRIEF SUMMARY OF THE INVENTION

The invention is an automatic gun including a double-barrel wherein each barrel includes a bore having a longitudinal axis for alternately firing beltless cased ammunition from each barrel. The gun comprises an oscillating breech or flipper having two breech chambers defined therein. The oscillating breech has a longitudinal axis generally parallel to the longitudinal axis of the double barrels. The oscillating breech rotates in an oscillating cycle about the longitudinal axis of the breech to alternately position each one of the two breeched chambers defined in the oscillating breech in alignment with a corresponding barrel bore defined in a respective one of the double barrels. The breech chambers defined in the oscillating breech are opened at each opposing end of each chamber to permit the ammunition to be slidingly disposed therethrough. A mechanism is coupled to the breech for rotating the breech in the oscillating cycle about its longitudinal axis. A first ammunition chute is also provided and generally disposed transversely with respect to the longitudinal axis of the oscillating breech. Similarly, a second ammunition chute is transversely disposed with respect to the longitudinal axis of the breech and is disposed on the opposite side of the oscillating breech from the first ammunition chute. In other words, the first and second ammunition chutes are disposed on opposing sides of the oscillating breech and generally aligned in the same plane. The double barrels are disposed below the plane of the first and second ammunition chutes. The oscillating breech alternately rotates each chamber of the breech in alignment with the first and second ammunition chutes and subsequently in alignment with a corresponding one of the barrel bores. A mechanism for end loading each breech chamber when the breech chamber is rotated in upward position in alignment with the first and second ammunition chutes is also included. The loading mechanism includes a cocked rammer which is arranged and configured to force the ammunition from the first and second ammunition chutes into the oscillating breech. The ammunition is loaded into each of the breech chambers from either the first or second ammunition chutes thereby forcing ammunition which had previously been loaded in the corresponding breech chamber and fired, or possibly not fired due to malfunction, from the breech chamber into the opposing ammunition chute. Finally, a buffer mechanism opposing the loader mechanism provided on each ammunition chute buffers the shock of ejection of the ammunition by the loading mechanism from the breech chambers into the opposing ammunition chute.

The method of the present invention is a method for feeding beltless ammunition cartridges into an automatic gun which includes double barrels wherein each barrel has a barrel bore defined therein and is characterized by a longitudinal axis of the barrel bore. The method comprises the steps of delivering the beltless ammunition cartridges at a load position in a first and second ammunition chute. The ammunition chutes are generally disposed transversely with respect to the longitudinal axis of the barrel bores of the double barrels. The ammunition cartridge delivered to the load position within a corresponding ammunition chute is then forced into the breech chamber which is defined in an oscillating breech disposed between the first and second ammunition chutes. The oscillating breech chamber has a longitudinal axis which is generally parallel to the longitudinal axis of the double barrels and rotates in an oscillating cycle about the longitudinal axis of the breech to alternately position each one of the two breech chambers in alignment with a corresponding load position in the ammunition chutes. The method continues by forcing a spent ammunition cartridge from each of the corresponding breech chambers into the opposite ammunition chute when the unfired ammunition cartridge is forced into the corresponding breech chamber during the proceeding step of loading. By this method, beltless ammunition cartridges may be delivered to an automatic gun having double barrels with a quick and smooth action.

The present invention and its various embodiments are better understood by considering the following drawings wherein like elements are referenced by like numerals.

The present invention and its various embodiments are better understood by considering the above figures in light of the following detailed description.

DETAILED DESCRIPTION OF THE PREFERRED EMBODIMENTS

The invention is an automated weapons system and in particular an ammunition feeding system in an automatic gun for feeding beltless cartridges to multiple-barreled gun. In the illustrated embodiment, two twin barrels are laid side-by-side and are provided with ammunition by an oscillating breech or flipper. For the purposes of this specification "breech" or hereinafter flipper will be taken to mean the oscillating member which aligns the round with the barrel bore regardless of whether or not another member then inserts the round into or seals the end of the bore during firing. The oscillating flipper both delivers unfired rounds to the barrels and returns the spent cartridge to two corresponding ammunition chutes. The ammunition chutes are disposed above and transversely to the longitudinal axis of the twin barrels. Each chute carries both unfired rounds and spent cartridges. A first chute is provided behind the oscillating flipper to provide unfired rounds to a first chamber in the flipper. The unfired round is provided from the first chute to the first flipper chamber when the flipper chamber is oscillated upwardly in alignment with the first ammunition chute. The flipper then oscillates downwardly to a position of alignment with a first gun barrel and breech mechanism. The unfired round is then loaded into the breech and fired by conventional means leaving, or returning as may be the appropriate case, the spent cartridge to the first chamber within the flipper. The flipper then oscillates upwardly until the first flipper chamber is again aligned with the first ammunition chute. At this time, the first flipper chamber is also aligned with the second ammunition chute which lies in front of the flipper. The spent cartridge is then forced from the first chamber in the flipper into the second ammunition chute. The spent cartridge is then moved down the second ammunition chute and disposed of. The second flipper chamber is symmetrically disposed about the longitudinal axis of the flipper and operates in conjunction with the first and second ammunition chutes and second barrel in an analogous manner to that described in connection with the first and second ammunition chutes, first flipper chamber and first barrel. However, unfired rounds are delivered through the second ammunition chute, loaded into the second flipper chamber, fired in the second barrel and then the spent cartridges are delivered to the first ammunition chute and disposed of.

Figure 1:
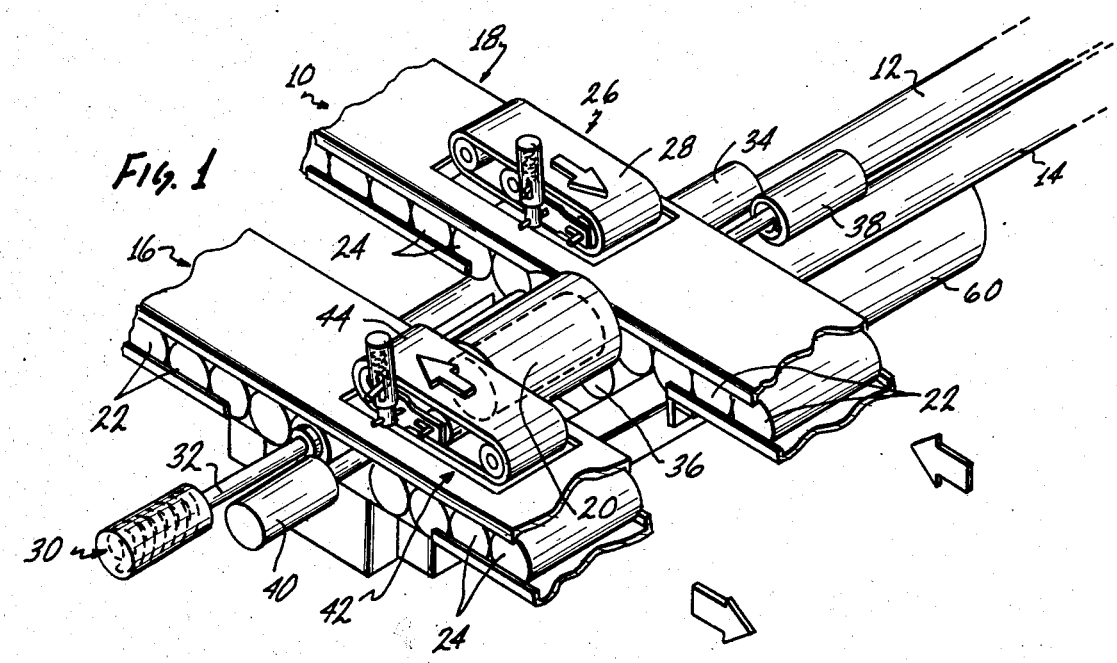
FIG. 1 is a partial perspective view of the invention.

The invention and its various embodiments are better understood by now turning to FIG. 1. FIG. 1 is a partial perspective in cutaway view of the material operative elements of the invention. The weapon system, generally denoted by reference numeral 10, includes a first barrel 12, a second barrel 14, first ammunition chute 16, second ammunition chute 18 and flipper 20. As illustrated in FIG. 1, unfired rounds 22 move by conventional means through first ammunition chute 16 from left to right until they reach a load position within chute 16. As previously described, unfired rounds will be loaded into flipper 20, fired, and the spent rounds will be returned by flipper 20 to second ammunition chute 18. Spent rounds 24 then move from right to left in second ammunition chute 18 as illustrated in FIG. 1. A belted cartridge driver 26 is disposed on the top of second chute 18 and frictionally contacts the upper sides of spent cartridges 24 by means of a gas driven or electrical driven frictional belt 28 which is run in a direction so as to impart an injection force to spent cartridges 24 to move cartridges 24 from the right to the left as illustrated in FIG. 1. A similar cartridge driver (not shown) is provided upstream of flipper 20 in each chute 16 and 18 to urge rounds 22 toward the load position within each chute. Unfired rounds 22 and spent cartridges 24 are forced into flipper 20 from first ammunition chute 16 and through flipper 20 into second ammunition chute 18, respectively, by means of a rammer 30, described in greater detail below, which includes a ramming rod 32 which applies an axially aligned end force to unfired rounds 22 and spent cartridges 24 to physically force rounds 22 into and cartridges 24 from flipper 20. A shock absorbing buffer is aligned along the axis of the load position in first and second ammunition chutes 16 and 18 to absorb the force of axial impact of spent cartridges 24 as they are forcefully rammed by rammer 30 from flipper 20 into second ammunition chute 18.

Similarly, unfired rounds 22 move from the right to the left in second ammunition chute 18 and are forced into a second flipper chamber 36 shown in dotted outline in FIG. 1, the first flipper chamber being concealed out of view in FIG. 1. A similar rammer 38 forces unfired rounds 22 into second flipper chamber 36 which is aligned with first and second ammunition chutes 16 and 18 in the view of FIG. 1. Flipper 20 rotates downwardly to second barrel 14 and the round is fired. The spent cartridge 24 is returned by flipper 20 and axially aligned with first chute 16, whereupon rammer 38 forces spent cartridge 24 into first ammunition chute 16. Again, a cartridge buffer 40 is aligned in the load position corresponding to second flipper chamber 36 and absorbs the impact of spent cartridge 24 as it is forced into chute 16. A cartridge driver 42 identical to driver 26 described in connection with second ammunition chute 18 is similarly provided on first ammunition chute 16. Cartridge driver 42 also includes a belt 44 driven in a direction and in contact with the upper surfaces of spent cartridges 24 in first ammunition chute 16, so that spent cartridges 24 are removed from the load position in first ammunition chute 16. Therefore, unfired rounds 22 and spent cartridges 24 both move right to left in second ammunition chute 18 and from left to right in first ammunition chute 16 in the view of FIG. 1.

Figure 2:
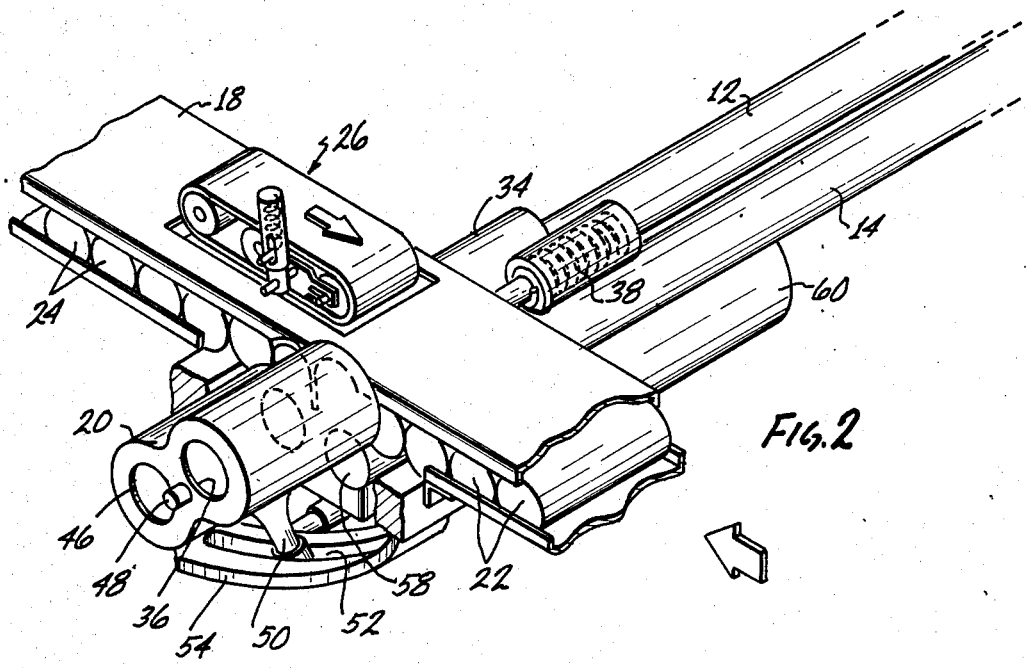
FIG. 2 is a partial perspective and elevational view taken through line 2—2 of FIG. 1.

Turn now to FIG. 2, which is a sectional elevational perspective view taken through line 2—2 of FIG. 1. Both first flipper chamber 46 and second flipper chamber 36 are clearly shown and are defined as throughbores running completely through binocular-shaped flipper 20. Flipper 20 rotates about a trunion 48 provided at each end of flipper 20, one of which such trunions is shown in FIG. 2. Trunion 48 is located on the vertical plane of symmetry of flipper 20 and slightly below the longitudinal axis of flipper 20 to provide an eccentric lift to flipper chambers 36 and 46. A cam follower 50 is connected to flipper 20 and extends downwardly to slidingly engage slot 52 defined in cam plate 54. Thus, flipper 20 is oscillated by means better described in connection with FIGS. 3 and 4 under the control of cam plate 54 from an alignment position with ammunition chute 16 and 18 to an alignment position with breech bores 56 and 58 corresponding to first and second barrels 12 and 14, respectively.

Figure 3:
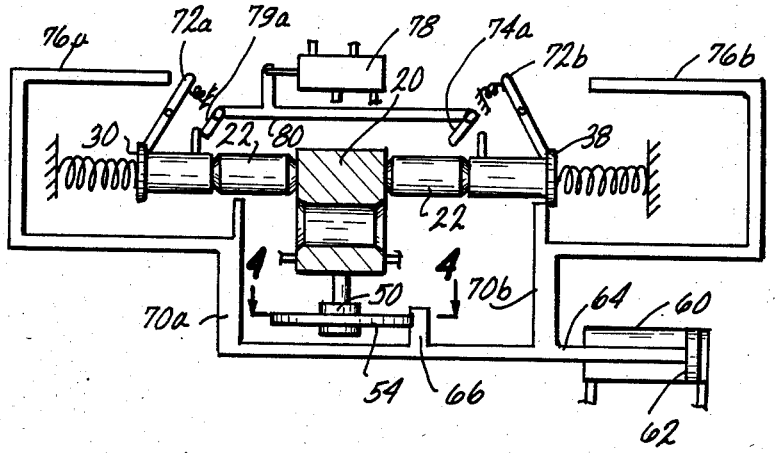
FIG. 3 is a diagrammatic side view of the loading mechanism shown in FIGS. 1 and 2.
Figure 4:
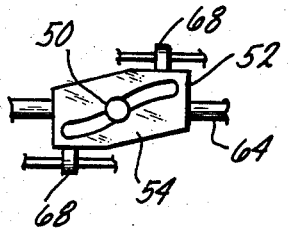
FIG. 4 is a plan elevational view taken through line 4—4 of FIG. 3.

Turn now to the diagrammatic side view in FIG. 3 depicting the gun illustrated in FIGS. 1 and 2 wherein the motive forces between the cooperating elements of the invention are described. In the first illustrated embodiment, weapon system 10 is powered by buffered pnuematic cylinder 60 communicating with and powered by discharge gases from barrels 12 and 14. For the sake of clarity, the means for gaseous communication have been omitted from the Figure. Piston 62 within pnuematic cylinder 60 drives a rod 64 connected to cam plate 54. Rod 64 reciprocates in a forward and rearward direction within weapon system 10, which is shown as a left-to-right movement in the view of FIG. 3. Flange 66 rigidly connects cam plate 54 to reciprocating rod 64. As better shown in diagrammatic plan view in FIG. 4 taken through line 4—4 of FIG. 3, cam 54 includes a serpentine slot 52 through which cam follower 50 is disposed. Cam follower 50 is slidingly held within a horizontal plane by means of sliding end bearings 68. As cam plate 54 reciprocates from the left to right as shown in FIG. 4 with reciprocating rod 64, serpentine slot 52 will be driven from one extremity to the other past cam follower 50 thereby causing flipper 20 to rotate about trunion 48. A dwell period is provided at the end movement of cam follower within slot 52, during which dwell period cartridges 22 are loaded into flipper 20 as described in greater detail in connection with the timing diagram of FIG. 5.

Rammers 30 and 38 are also driven by means of coupling with reciprocating rod 64. Extensions 70*a* and *b* from rod 64 extends upwardly from rod 64 to each rammer. For example, first rammer 30 is cocked against a spring loaded drive by extension 70*a* as rod 64 and extension 70*a* move from the right to the left in the view of FIG. 3. When fully cocked, rammer 30 is locked into position by latch 72*a* bearing against flange 74*a*.

Similarly, second rammer 38 is moved from the left to the right by extension 70*b* thereby compressing its corresponding spring load and being latched in position by latch 72*b* bearing against flange 74*b*. Latches 72*a* and 72*b* are triggered by extensions 76*a* and 76*b* connected to rod 64, or as diagrammatically shown in FIG. 3, indirectly connected to rod 64 through extensions 70*a* and 70*b*, respectively. Thus, as first rammer 30 is being cocked against its spring load by extension 70*a*, second rammer 38*a* which would have previously have been cocked is triggered by contact between extension 76*b* with latch 72*b*. The released rammer 38 is driven by a spring thereby forcing cartridge 22 against the spent cartridge within the corresponding bore in flipper 20 to effectuate the through-load of the round into flipper 20 as previously described in connection with FIGS. 1 and 2.

Reciprocating movement of buffered pnuematic cylinder 60 is controlled by a shuttle valve 78. Shuttle valve 78 in turn is operated by linkage, generally denoted by reference numeral 80. Linkage 80 comprises a stem connected to shuttle valve 78, an arm, toggle levers 79*a* and *b*, and tabs. Stem 81 is rigidly connected to and integral with longitudinal arm which is free to reciprocate in a direction generally parallel to the reciprocation of rammers 30 and 38. Each end of arm is rotatably coupled to a corresponding lever 79*a* or 79*b*. Each lever 79*a* and *b* pivots about a fixed pivot point depicted in FIG. 3 as at the midpoint of each lever 79*a* or 79*b*. The opposing end of each lever 79*a* or 75*b* in turn is disposed to contact a rigid corresponding tab extending from rammer 30 or 38 respectively. Thus as rammers 30 and 38 move to load round 22 into flipper 20, tab respectively will cause arm 83 to reciprocate by virtue of the motive force coupled thereto through lever 74*a* or *b* respectively. Shuttle valve 78 is thus operated to control piston 60 in a closed loop pneumatic circuit, since the motive gas is provided to piston 60 through valve 78.

Figure 5:
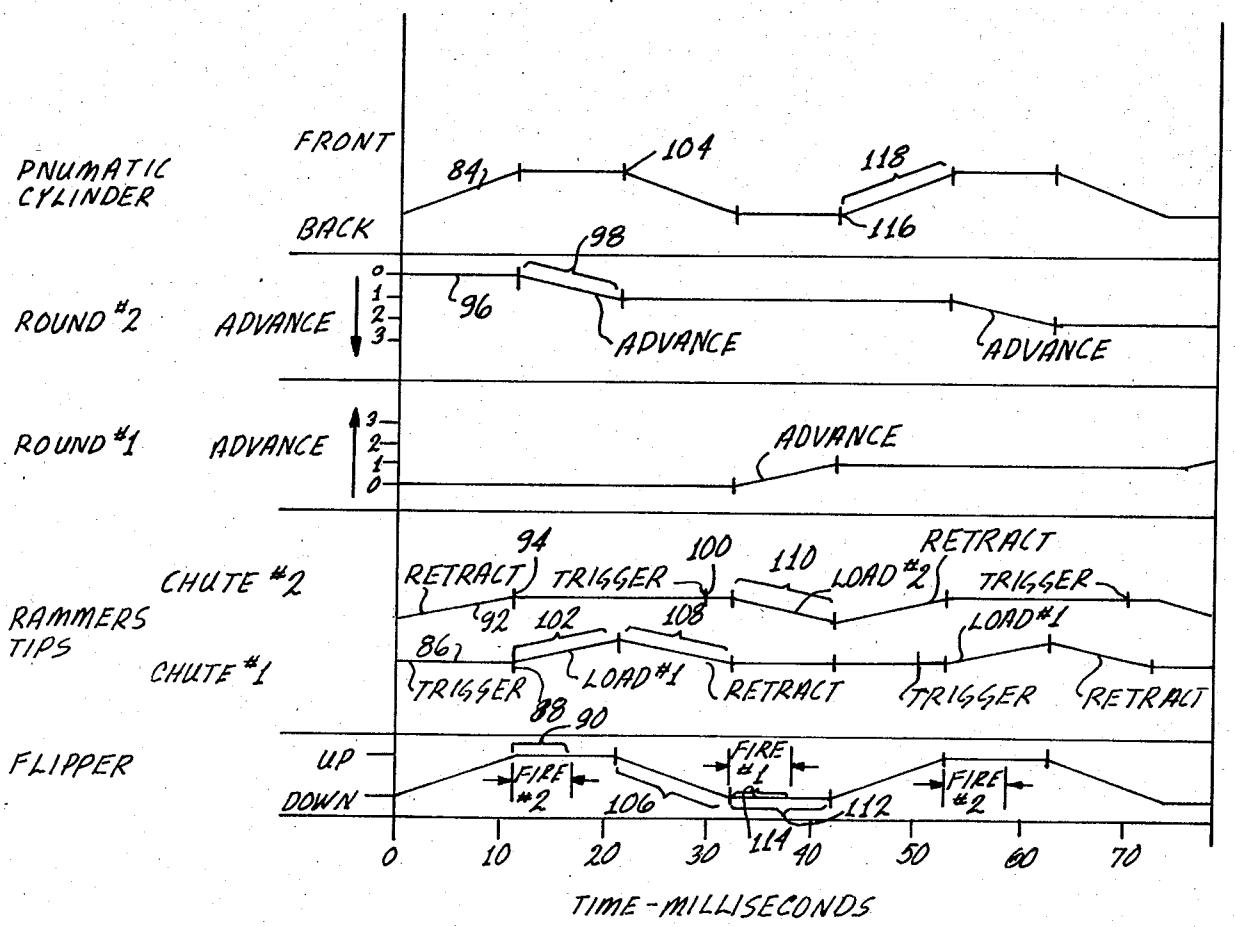
FIG. 5 is a timing diagram, illustrating the operation of the gun of FIGS. 1–4.

Turn now to FIG. 5 which illustrates the timing of weapon system 10 illustrated in FIGS. 1–4. The horizontal axis represents time in milliseconds. Line 82 represents the position of flipper 20 between the up position and down position corresponding, for example, to the up or down position of first flipper chamber 46. Beginning with a down position at time zero, flipper 20, or more specifically chamber 46, moves to the up position within approximately 11 milliseconds. Movement of flipper 20 is caused by the forward movement of pneumatic cylinder 60 in rod 62 as illustrated by line 84 at the top of FIG. 5. As flipper chamber 46 nears the up position first rammer 30, whose movement is represented by line 86, triggers at point 88 which causes the rammer to press up against the end of a live round 22 in first chute 16 which is lying in front of rammer 30. That live round cannot enter flipper chamber 46 until chamber 46 is in its full up position at the end of the stroke of piston 60. When flipper 20 is in the full up position, live round 22 is then in line with spent cartridge 24 which is then resting within chamber 46, and rammer 30 then forces round 22 into chamber 46 pushing spent cartridge 24 ahead of it into second ammunition chute 18.

Spent cartridge 24 butts up against buffer 34 described in FIG. 1 which stops both spent cartridge 24 and unfired round 22 within chamber 46. Buffer 34 stops round 22 with a less than 1000 G axial load. Meanwhile, a live round, which had been inserted in second flipper chamber 36 is fired during interval 90 shown of line 82. Flipper 20 remains in place during a dwell period indicated by line 82 extending from 11 milliseconds to 21 milliseconds after the beginning of the cycle for an interval of 10 milliseconds. However, prior to this time, second rammer 38 has been retracting as shown by line 92 and was latched in the cocked position at point 94. Second rammer 38 has been fully retracted from second ammunition chute 18 by time 94 after which a live round 22 will advance in ammunition chute 18 as illustrated by line 96 in FIG. 5. Advance of round 22 in chute 18 occurs during interval 98. This round is now in position to be loaded when second rammer 38 is triggered at point 100, as shown on line 92.

Meanwhile, rammer 30 has loaded a new round from first ammunition chute 60 into first flipper chamber 46 during interval 102 of line 86. At the end of its loading stroke, first rammer 30 will trigger shuttle valve 78 which causes pneumatic cylinder 60 to drive in the opposite direction as shown on line 84 beginning at point 104. This assures proper sequencing should the spring-loaded rammer be slowed due to dirt or debris. Flipper 20 cannot rotate on a partially rammed cartridge and a jam is therefore avoided. Rearward motion of rod 62 rotates flipper 20 downwardly as depicted in interval 106 of line 82 and also causes first rammer 30 to be retracted as shown in interval 108 of line 86. This ultimately triggers second rammer 38 at point 100 just prior to the load cycle during interval 110 shown on line 92. When the buffered piston within pneumatic cylinder 60 reaches its full stroke, flipper 20 dwells in its down position in interval 112 of line 82 and first barrel 12 is fired during interval 114. Second rammer 38 inserts an unfired round 22 into second flipper chamber 36 during interval 110 thereby pushing a spent cartridge 24 remaining in first flipper chamber 36 into first ammunition chute 16 for return. Ultimately, shuttle valve 78 is again tripped at point 116 as shown on line 84 by second rammer 38, thereby causing the piston within cylinder 60 to move forward during interval 118 to once again restart the cycle.

Figure 6:
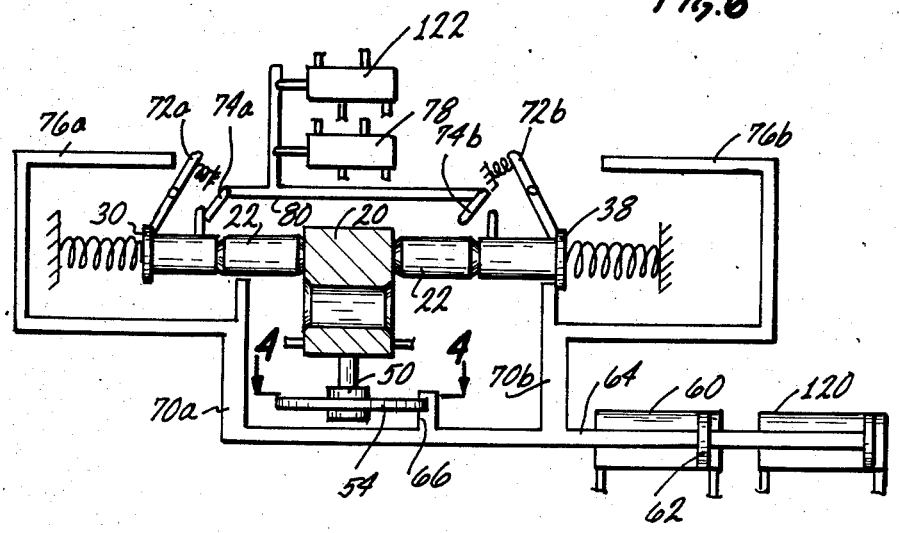
FIG. 6 is a diagrammatic side view of a second embodiment of the ammunition handling system.

A diagrammatic side view of a second embodiment of the invention is shown in FIG. 6 wherein the gun of FIGS. 1–5 has been modified to include a booster. In the first embodiment to FIGS. 1–5, weapon system 10 is primarily powered by gun gasses. In the boosted weapon system of the second embodiment, aircraft compressed air or electrical power is used to power the gun, especially when a dud is encountered. Should a dud round be encountered, the firing rate of weapon system 10 would momentarily drop from 2500 to 1395 rounds per minute until the dud is replaced and the gun begins firing again at the higher rate. Turning now to FIG. 6, a booster cylinder 120 is connected in tandem to pneumtic cylinder 60 previously described. Both cylinders are controlled by separate shuttle valves to prevent mixing of gun gasses and aircraft compressed air. In other words, cylinder 60 continues to be controlled by shuttle valve 78. The pneumatic circuit has been omitted for the sake of clarity and is provided between shuttle valves 78 and cylinder 60 in a conventional manner. Booster cylinder 120 is in turn controlled by an independent shuttle valve 122. However, shuttle valves 78 and 122 are both connected and in tandem with the same linkage 80 which is driven by rammers 30 and 38. Booster cylinder 120 runs on compressed air from the aircraft or gun vehicle. Buffered cylinders 60 continues to be operated solely by discharge gasses from weapon system 10. In the illustrated embodiment, booster cylinder 120 produces approximately 90% of the power requirement to operate weapon system 10.

Figure 7:
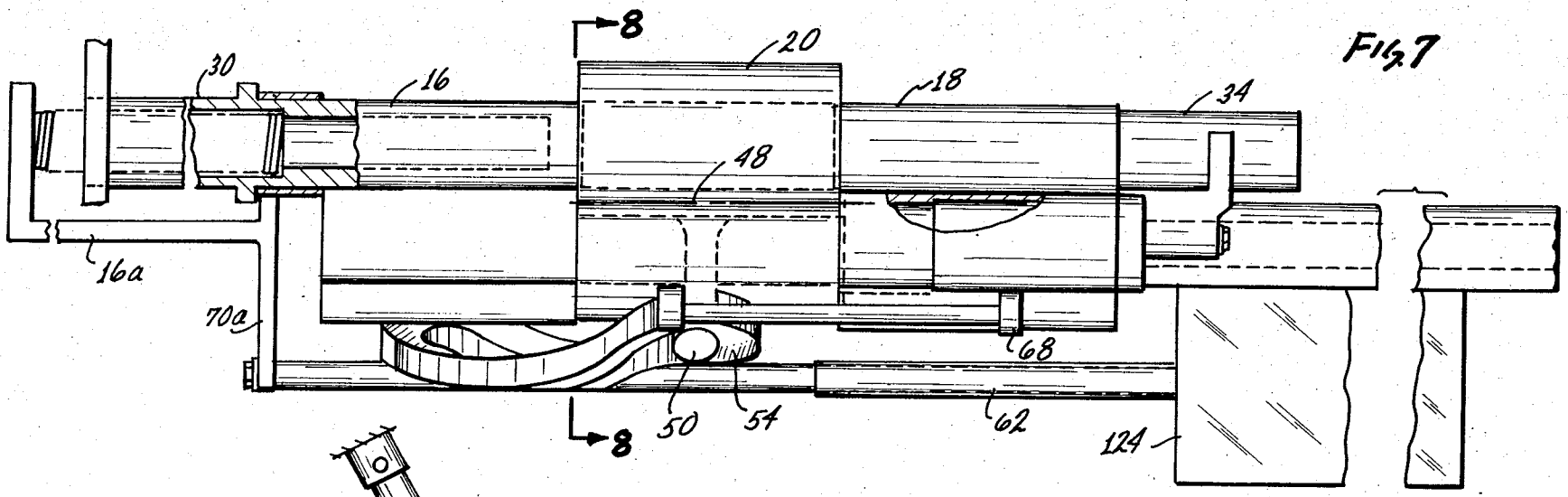
FIG. 7 is a side elevational and partly cutaway view of the gun diagrammatically depicted in FIG. 6.
Figure 8:
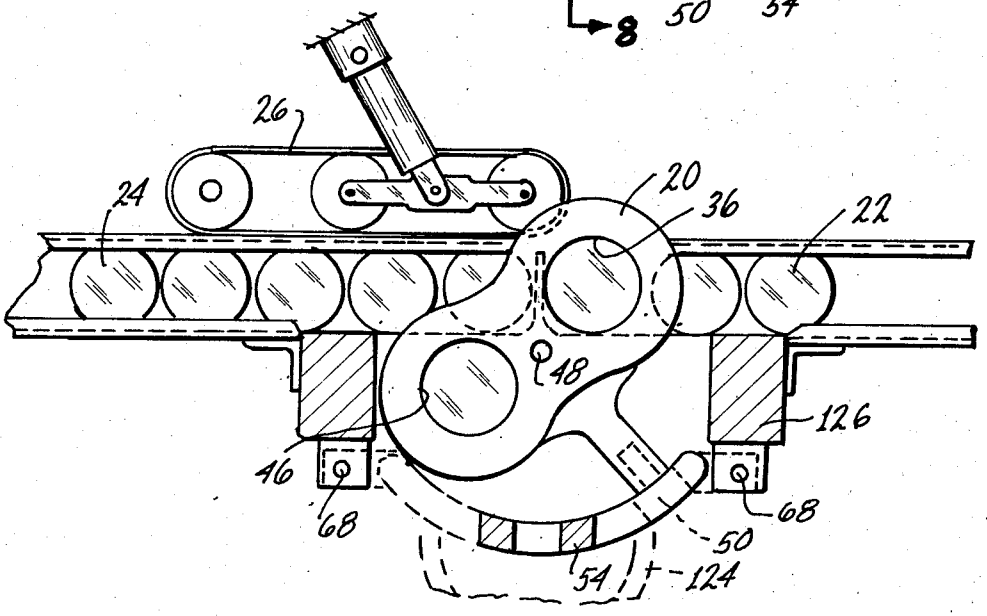
FIG. 8 is a cross-sectional view taken through line 8—8 of FIG. 7.

Turn now to FIG. 7 which shows a side elevational assembly view of weapon system 10. Rod 62 extends from a cylinder housing 124 which includes both pneumatic cylinder 60 and booster cylinder 120. Cam plate 54, in actuality, is not a flat plate as suggested by the simplified drawings of FIGS. 1–6, but is a plate curved to accommodate the rotational movement of cam follower 50 as flipper 20 rotates, the curvature of which is better shown in sectional view in FIG. 8 taken through line 8—8 of FIG. 7. FIG. 8 graphically illustrates the alignment of flipper chambers 36 and 46 when flippers 20 reaches the extreme dwell position within cam plate 54 leaving one flipper chamber in alignment with its corresponding ammunition chute, and the other flipper chamber in alignment with its corresponding gun barrel. A breech block 126 provides a reference attachment point for each of the elements of the gun. Namely, for ammunition chutes 16 and 18, for pivotal coupling to flipper 20, for sliding attachment through bearings 68 as best shown in the sectional view of FIG. 8 and for the slidable mounting of rammers 30 and 38 as shown with respect to rammer 30, in partial cutaway view in FIG. 7.

Many alterations or modifications may be made by those having ordinary skill in the art without departing from the spirit and the scope of the invention. The illustrated embodiment has been shown only for the purposes of example and should not be taken as limiting the invention as defined in the following claims.

I claim:

1. An improvement in an automatic gun including a double-barrel each with a barrel bore having a longitudinal axis for alternately firing beltless cased ammunition from each barrel comprising:

an oscillating breech having two chambers defined therein, said oscillating breech having a longitudinal axis generally parallel to said longitudinal axes of said double barrels, said oscillating breech rotating in an oscillating cycle about said longitudinal axis of said breech to alternately position each one of said two chambers defined in said oscillating breech in alignment with a corresponding barrel bore defined in a respective one of said double barrels, said chambers defined in said oscillating breech being opened at each opposing end of each chamber to permit said beltless cased ammunition to be slidingly disposed therethrough;

means for rotating said oscillating breech in said oscillating cycle about said longitudinal axis of said oscillating breech, said means for rotating coupled to said oscillating breech;

a first ammunition chute generally disposed transversely with respect to said longitudinal axis of said oscillating breech;

a second ammunition chute transversely disposed with respect to said longitudinal axis of said oscillating breech and disposed opposite said first ammunition chute, said first and second ammunition chutes disposed on opposing sides of said oscillating breech and aligned generally in the same plane, said double barrels aligned below said plane of said first and second ammunition chutes, said oscillating breech alternately rotating each chamber of said oscillating breech in alignment with said first and second ammunition chutes and subsequently in alignment with a corresponding one of said barrel bores;

means for loading each said chamber when said corresponding chamber is rotated in an upward position in alignment with said first and second ammunition chutes, same means for loading including a cocked rammer arranged and configured to force said beltless cased ammunition from said first and second ammunition chutes into said oscillating breech, said beltless cased ammunition being loaded in each of said chambers from one of said first and second ammunition chutes thereby forcing said beltless cased ammunition previously loaded in said corresponding chamber therefrom into an opposing one of said first and second ammunition chutes; and buffer means opposing each means for loading to buffer the shock of said beltless cased ammunition being forced through said corresponding chamber into said opposing ammunition chute by said means for loading, whereby said automatic gun is fired at a rapid rate using beltless cased ammunition in such a manner that delivery of unfired beltless cased ammunition to and spent beltless cased ammunition from said automatic gun is facilitated.

2. The improvement of claim 1 wherein said oscillating breech is a symmetrical binocular-shaped body in which said chambers are defined, said body having a longitudinal axis of symmetry parallel to the longitudinal axis of each of said chambers, and said oscillating breech being rotatable about trunnion pins extending from said body, said trunnion pins extending from said body and lying in a plane of symmetry between said two chambers and below said longitudinal axis of said body.

3. The improvement of claim 1 wherein said means for rotating said oscillating breech includes a cam follower extending from said breech, said cam follower slidingly engaging a cam plate, said cam plate reciprocating in a longitudinal direction parallel to the axis of rotation of said oscillating breech.

4. The improvement of claim 3 wherein said means for rotating further includes a reciprocating rod coupled to said cam plate for reciprocating said cam plate in said direction parallel to said axis of rotation of said oscillating breech, said reciprocating rod being coupled to a piston included within a pneumatic cylinder, said pneumatic cylinder having pressurized gas supplied thereto from said automatic gun.

5. The improvement of claim 3 wherein said means for rotating said oscillating breech includes a cam follower extending from said breech, said cam follower slidingly engaging a cam plate, said cam plate reciprocating in a longitudinal direction to the axis of rotation of said oscillating breech.

6. The improvement of claim 1 wherein said means for rotating includes a reciprocating rod and pneumatic cylinder including a piston therein and wherein said means for loading each said chamber including said cocked rammer is coupled to said reciprocating rod and wherein said means for rotating said oscillating breech further includes a shuttle valve communicating with said piston in said pneumatic cylinder, said shuttle valve reversing gas flow to said piston thereby reversing direction of movement of said piston, and wherein said means for loading includes a first extension extending from said rod and engaging each said rammer to cock said rammer and a second extension from said rod coupled to said shuttle valve to control switching of said shuttle valve whereby reciprocation of said piston and rod coupled thereto is self-actuating.

7. The improvement of claim 6 including an external source of compressed air wherein said rod is coupled in tandem with a pneumatic cylinder and booster cylinder, said rod being powered by said pneumatic cylinder driven by discharge gas from said automatic gun and by said booster cylinder driven by said external source of compressed air, said booster cylinder further including a second shuttle valve controlled by said second extension connected to said rod, whereby said pneumatic cylinder and first shuttle valve and whereby said booster cylinder and said second shuttle valve provide two independent motive power sources in tandem for reciprocating said rod and causing said oscillating breech to rotate.

8. An improvement in an automatic gun system icluding multiple barrels comprising:

an oscillating breech having a corresponding multiple number of chamber defined therein, said oscillating breech having a longitudinal axis generally parallel to said longitudinal axes of said multiple barrels, said oscillating breech rotating in an oscillating cycle above said longitudinal axis of said breech to position each one of said plurality of chambers defined in said oscillating breech in alignment with a corresponding barrel bore defined in respective ones of said multiple barrels, said chambers defined in said oscillating breech being opened at each opposing end of each chamber to permit said ammunition to be slidingly disposed therethrough;

a first ammunition chute generally disposed transversely with respect to said longitudinal axis of said oscillating breech; and a second ammunition chute transversely disposed with respect to said longitudinal axis of said breech and disposed opposite said first ammunition chute, said first and second ammunition chute disposed on opposing sides of said oscillating breech and generally aligned in the same plane with each other, said multiple barrels being offset from said plane in which said first and second ammunition chutes lie, said oscillating breech cyclically rotating each first and second ammunition chutes and subsequently in alignment with a corresponding one of said multiple barrel bores, whereby unfired ammunition is taken from one of said first and second ammunition chutes, fired by said automatic gun system, and returned to an opposing one of said first and second ammunition chutes.

9. The improvement of claim 8 further including means for loading each chamber within said oscillating breech when said corresponding chamber is rotated into a position in alignment with one of said first and second ammunition chutes, said means for loading disposing a round of ammunition from one of said first and second ammunition chutes into said corresponding chamber in said oscillating breech thereby forcing a spent round from said chamber into an opposing one of said first and second ammunition chutes.

10. A method for feeding beltless ammunition cartridges to an automatic gun including double barrels, wherein each barrel has a barrel bore defined therein and characterized by a longitudinal axis of said barrel bore, said method comprising the steps of:

delivering said beltless ammunition cartridges at a load position in a first and second ammunition chute, said ammunition chutes generally disposed transversely with respect to said longitudinal axis of said barrel bores of said double barrels;

forcing an unfired ammunition cartridge delivered to said load position within said first ammunition chute into a breech chamber defined in an oscillating breech disposed between said first and second ammunition chutes, said oscillating breech having a longitudinal axis generally parallel to said longitudinal axis of said double barrels and arranged and configured to oscillate about said longitudinal axis of said breech to alternately position each one of said two breech chambers defined in said oscillating breech alignment with said corresponding load position in said ammunition chutes; and simultaneously forcing a spent ammunition cartridge from each corresponding breech chamber into an opposite one of said first and second ammunition chutes when said unfired ammunition cartridge is forced into said corresponding breech chamber during said preceding step of loading, whereby beltless ammunition cartridges may be delivered to an automatic gun having double barrels with quick and smooth action.

11. The method of claim 10 further including the step of aligning one breech chamber having an unfired ammunition cartridge just loaded therein during said step of forcing unfired ammunition therein with a corresponding barrel bore in preparation for firing said amumunition cartridge through said corresponding barrel bore, said alignment being effected by oscillatory rotation of said breech about said lontitudinal axis of said breech, said alignment of said one breech chamber rotating another breech chamber into alignment with said other load position in said other ammuntion chute in preparation for said step of forcing an unfired cartridge into said corresponding breech chamber.

12. The method of claim 11 wherein said steps of delivering, forcing said ammunition cartridge delivered to said load position within said corresponding ammunition chute into a breech chamber, simultaneously forcing a spent ammunition cartridge from each corresponding breech chamber into an opposite one of said first and second ammunition chutes, and aligning said breech chamber having an unfired ammunition cartridge just loaded therein with a corresponding barrel bore are cyclically repeated after the additional step of rotating said oscillating breech after said unfired ammunition cartridge has been fired, said breech being rotated to a load position corresponding with said second ammunition chute wherein said step of forcing said ammunition cartridge delivered to said load position in said second ammunition chute and simultaneously forcing a spent ammunition cartridge from said corresponding breech chamber into said opposing ammunition chutes is repeated and followed by a repitition of said step of aligning said breech chamber including an unfired ammuntion cartridge just loaded from said second ammunition chute with a corresponding barrel bore, whereafter said steps of delivering, forcing and simultaneously forcing are repeated with respect to the other one of said breech chambers defined in said oscillating breech.

13. An improvement in a method for feeding beltless ammunition cartridges to an automatic gun including a rotating breech and multiple barrels, wherein each barrel has a barrel bore defined therein characterized by a longitudinal axis of said corresponding barrel bore, said improvement comprising the steps of:

forcing an ammunition cartridge from a first one of two opposing ammunition chutes into said rotating breech, said rotating breech having a corresponding multiplicity of chambers defined therethrough, each chamber corresponding to at least one of said multiple barrels; and simultaneously forcing a spent ammunition cartridge disposed in one of said chambers by a force exerted thereon by said ammunition cartridge delivered to a load position and disposed into said rotating breech by said step of forcing said unfired ammunition cartridge therein, said spent ammunition cartridge being disposed in an eject position in said opposing ammunition chute, movement of said spend cartridge being limited within said opposing ammunition chute so that said unfired ammunition cartridge being forced from said load position in said first opposing ammunition chute is retained in said rotating breech.

14. The improvement of claim 13 further including the step of rotating said rotating breech to align another one of said multiplicity of chambers defined in said rotating breech with a load position in a second one of said ammunition chutes and an eject position in said first ammunition chute.

15. The improvement of claim 14 further including the step of simultaneously rotating one of said multiplicity of chambers defined in said rotating breech, said chamber including an unfired ammunition cartridge and being rotating in alignment with corresponding one of said barrel bores in preparation for firing.

16. The improvement of claim 15 wherein said rotating breech includes two chambers defined therein, and where in said step of rotating, rotation of said rotating breech aligns a first one of said two chambers with a corresponding one of two barrel bores and the second one of said two chambers is aligned with said load position on said first one of said ammunition chutes and with said eject position on said second one of said ammunition chutes.

* * * * *